US011771614B2

(12) United States Patent
Keene

(10) Patent No.: US 11,771,614 B2
(45) Date of Patent: Oct. 3, 2023

(54) WALKING ASSISTANCE ASSEMBLY

(71) Applicant: Doris Keene, Danville, VA (US)

(72) Inventor: Doris Keene, Danville, VA (US)

( * ) Notice: Subject to any disclaimer, the term of this patent is extended or adjusted under 35 U.S.C. 154(b) by 210 days.

(21) Appl. No.: 16/816,443

(22) Filed: Mar. 12, 2020

(65) Prior Publication Data

US 2021/0283002 A1 Sep. 16, 2021

(51) Int. Cl.
*A61H 3/04* (2006.01)
*A47D 13/04* (2006.01)
*A61H 3/00* (2006.01)

(52) U.S. Cl.
CPC ..... *A61H 3/04* (2013.01); *A47D 13/04* (2013.01); *A47D 13/043* (2013.01); *A61H 2003/004* (2013.01); *A61H 2201/1633* (2013.01)

(58) Field of Classification Search
CPC ..... A61H 3/04; A61H 2201/1633; A61H 1/0262; A61H 2003/004; A47D 13/04; A47D 13/043
USPC ..... 135/67; 280/87.021, 87.041; 297/5, 56, 297/344.18; 482/68
See application file for complete search history.

(56) References Cited

U.S. PATENT DOCUMENTS 2,788,054 A * 4/1957 Erickson ..... A47D 13/043 248/164
3,041,636 A * 7/1962 Twedt ..... A61G 7/1017 5/81.1 R
3,172,696 A * 3/1965 De Vos ..... A47D 13/043 248/588
3,326,570 A * 6/1967 Burnham ..... A47D 1/06 280/649
3,337,230 A * 8/1967 Golding ..... A47D 13/043 297/5
3,754,786 A * 8/1973 Boucher ..... A47D 13/043 248/164
3,759,539 A * 9/1973 Goldberg ..... H05K 7/1401 297/16.1
4,231,582 A * 11/1980 Moss ..... A47D 13/043 280/87.051
4,245,850 A * 1/1981 Boudreau ..... B62B 7/06 280/87.051
4,342,465 A 8/1982 Stillings
4,359,242 A * 11/1982 Gerken ..... A47D 13/043 280/87.051
4,452,484 A 6/1984 Pastor
(Continued)

FOREIGN PATENT DOCUMENTS

DE 202008009807 U1 * 11/2008 ..... A61H 3/04
DE 202017101709 U1 * 7/2017 ..... A47K 11/04
KR 10-1991588 B1 * 6/2019 ..... A61B 5/1116

*Primary Examiner* — Robert Canfield
(74) *Attorney, Agent, or Firm* — Stein IP, LLC

(57) ABSTRACT

A walking assistance assembly includes a set of first legs forming an X a set of second legs forming an X. A frame is coupled to each of the first and second sets of legs. Moreover, the frame is horizontally oriented when the first and second legs are in an unfolded position thereby facilitating the frame to surround a user. Each of the first and second legs supports the frame thereby supporting the weight of the user to assist the user with standing. A plurality of rollers is each of the rollers is rotatably coupled to a respective one of the first and second legs and each of the rollers can roll along a support surface. A seat is coupled between the set of first and second legs for having the user sit thereon.

12 Claims, 6 Drawing Sheets

(56) References Cited

U.S. PATENT DOCUMENTS 4,621,804 A * 11/1986 Mueller ..... A47D 13/043 280/87.051
4,708,274 A * 11/1987 Roche ..... A61H 3/00 224/407
4,770,410 A 9/1988 Brown
4,799,700 A * 1/1989 Knoedler ..... A47D 13/043 280/87.051
5,040,556 A 8/1991 Raines
5,050,862 A * 9/1991 Saghafi ..... A47D 1/008 280/87.051
5,083,806 A 1/1992 Brown
5,217,032 A * 6/1993 Jobst ..... A61H 3/00 297/5
5,271,422 A * 12/1993 Sorrell ..... A61H 3/04 135/66
5,324,064 A * 6/1994 Sumser ..... A47D 13/043 280/87.051
D356,532 S * 3/1995 Butzman ..... D6/406.1
5,476,432 A 12/1995 Dickens
D408,766 S * 4/1999 Rodgers ..... D12/130
6,120,045 A * 9/2000 Rosko ..... A47D 13/043 280/87.051
6,513,869 B1 * 2/2003 Wu ..... A47D 13/043 297/130
D510,481 S * 10/2005 Hodgson ..... D3/304
7,547,027 B2 6/2009 Bohn
8,016,305 B2 * 9/2011 Cheng ..... A47D 13/043 280/87.051
8,573,612 B1 * 11/2013 Fulk ..... A61H 3/04 482/68
9,144,324 B1 * 9/2015 Champagne ..... A47D 13/046
9,211,000 B1 * 12/2015 Storkel ..... A61H 3/04
10,407,089 B1 * 9/2019 Matranga ..... A47D 13/043
10,426,678 B2 * 10/2019 Tamney ..... A61G 7/1059
10,722,420 B1 * 7/2020 Miller ..... A61H 3/04
11,376,471 B2 * 7/2022 Yamaguchi ..... A61H 1/00
2004/0119258 A1 * 6/2004 Yoo ..... A47D 1/004 280/87.051
2005/0183759 A1 8/2005 Wolfe
2009/0120479 A1 * 5/2009 McCarthy ..... A61H 3/04 224/407
2013/0341891 A1 * 12/2013 Brewin ..... A47D 13/04 280/658
2015/0238381 A1 * 8/2015 Swiniarski ..... A61H 3/04 297/5
2019/0209418 A1 * 7/2019 VanAusdall ..... B62B 5/0438
2019/0380509 A1 * 12/2019 Diep ..... A47D 1/02
2021/0127851 A1 * 5/2021 Diep ..... A47D 1/02
2021/0154083 A1 * 5/2021 Downes ..... A61H 3/00
2022/0202642 A1 * 6/2022 Lewis ..... A61H 3/008

* cited by examiner

WALKING ASSISTANCE ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and The disclosure and prior art relates to walking devices and more particularly pertains to a new walking device including a standing frame and a seat.

BRIEF SUMMARY OF THE INVENTION

An embodiment of the disclosure meets the needs presented above by generally comprising a set of first legs forming an X a set of second legs forming an X. A frame is coupled to each of the first and second sets of legs. Moreover, the frame is horizontally oriented when the first and second legs are in an unfolded position thereby facilitating the frame to surround a user. Each of the first and second legs supports the frame thereby supporting the weight of the user to assist the user with standing. A plurality of rollers is each of the rollers is rotatably coupled to a respective one of the first and second legs and each of the rollers can roll along a support surface. A seat is coupled between the set of first and second legs for having the user sit thereon.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
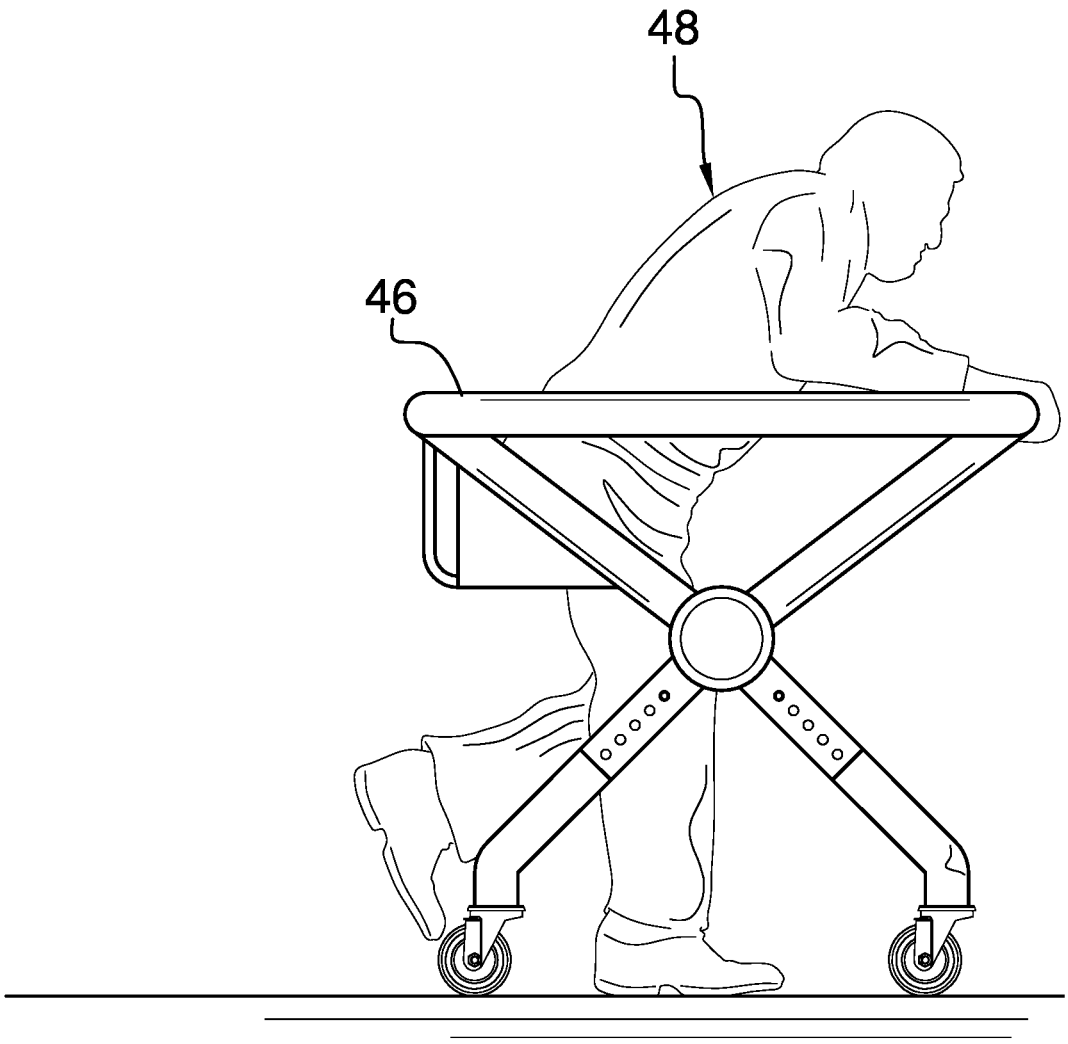
FIG. 1 is a perspective in-use view of a walking assistance assembly according to an embodiment of the disclosure.
Figure 2:
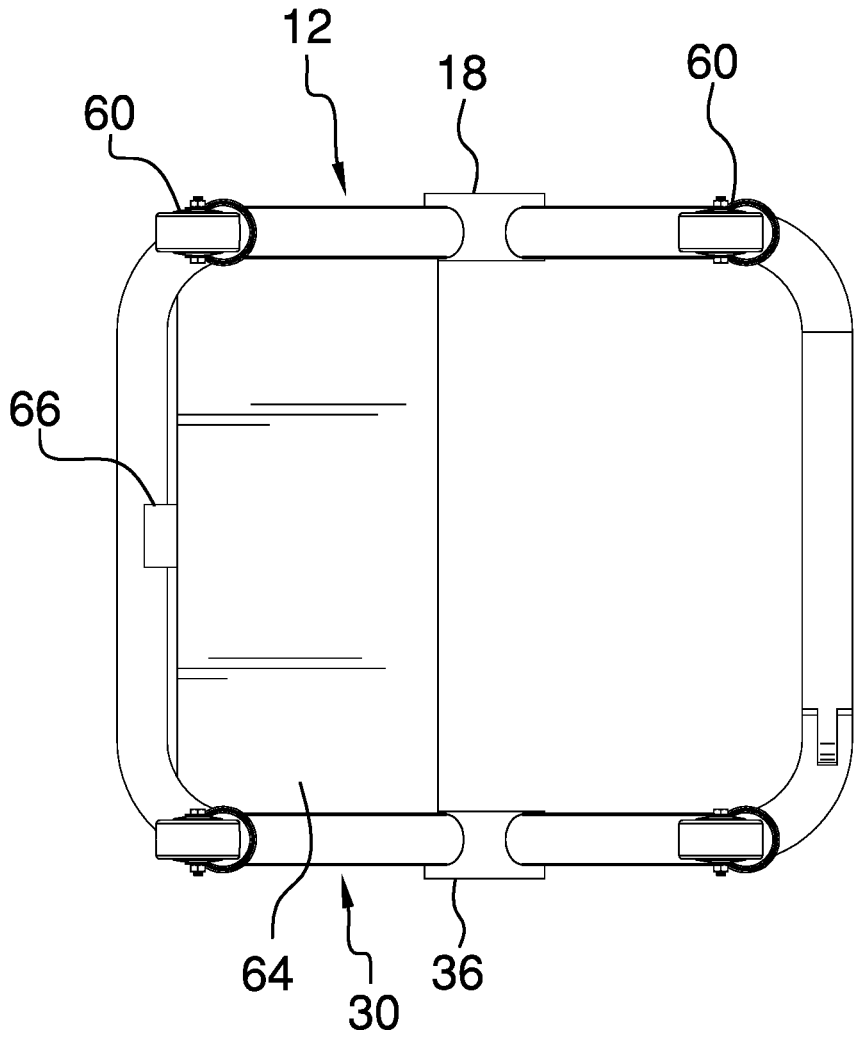
FIG. 2 is a bottom view of an embodiment of the disclosure.
Figure 3:
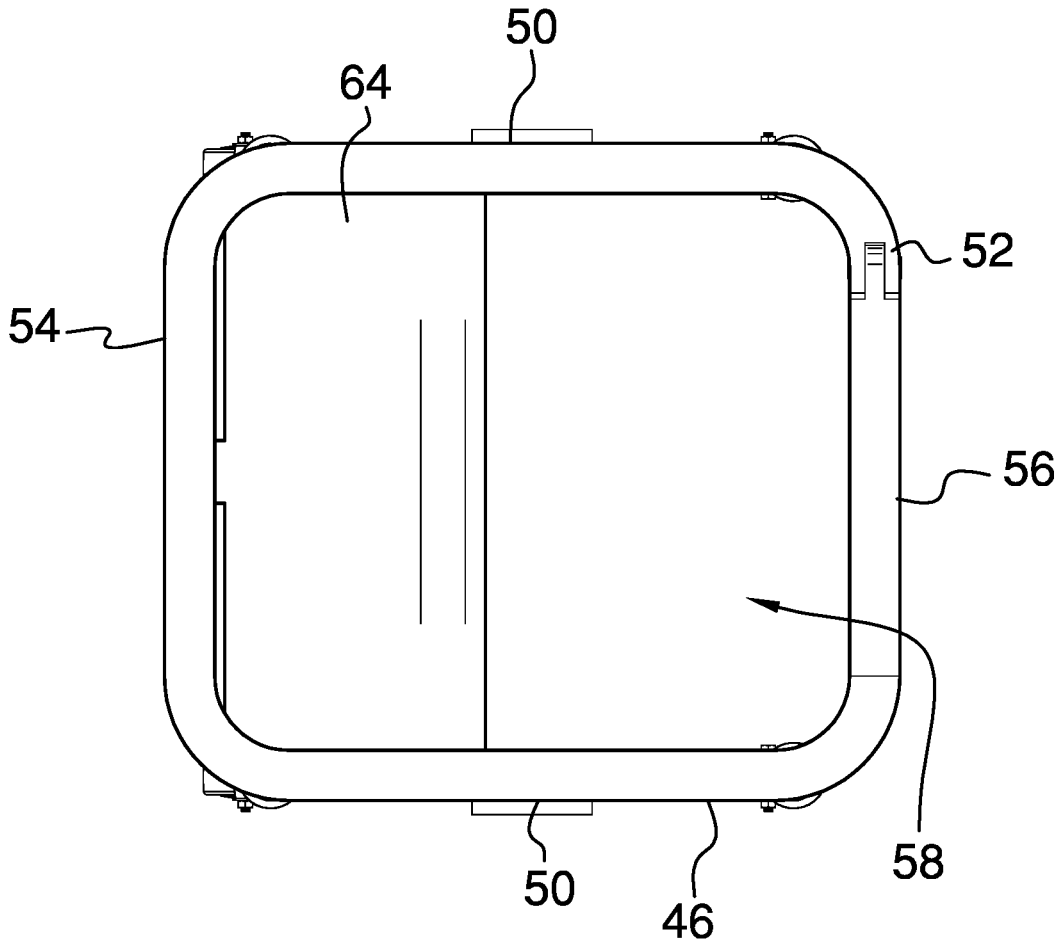
FIG. 3 is a top view of an embodiment of the disclosure.
Figure 4:
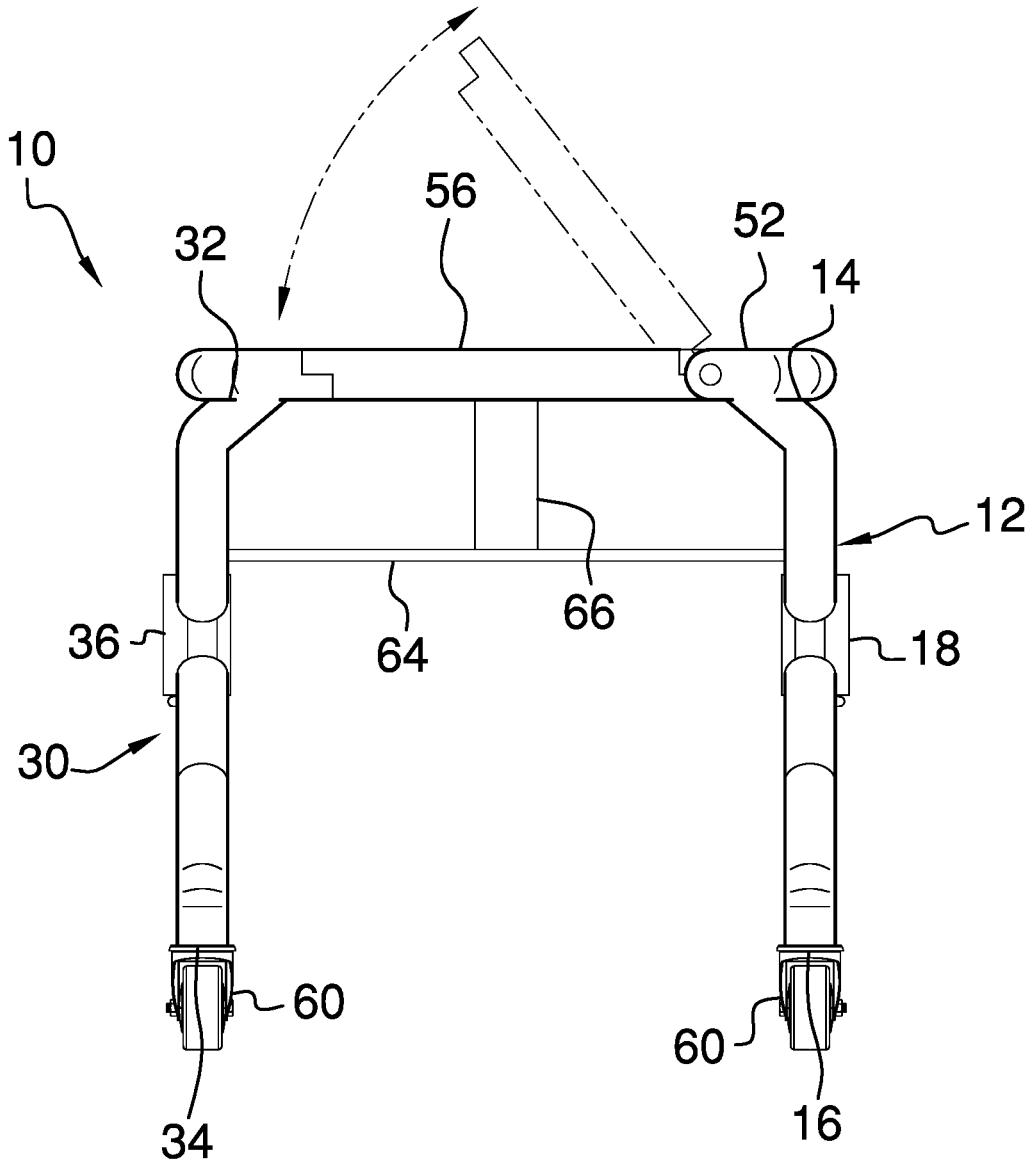
FIG. 4 is a front view of an embodiment of the disclosure.
Figure 5:
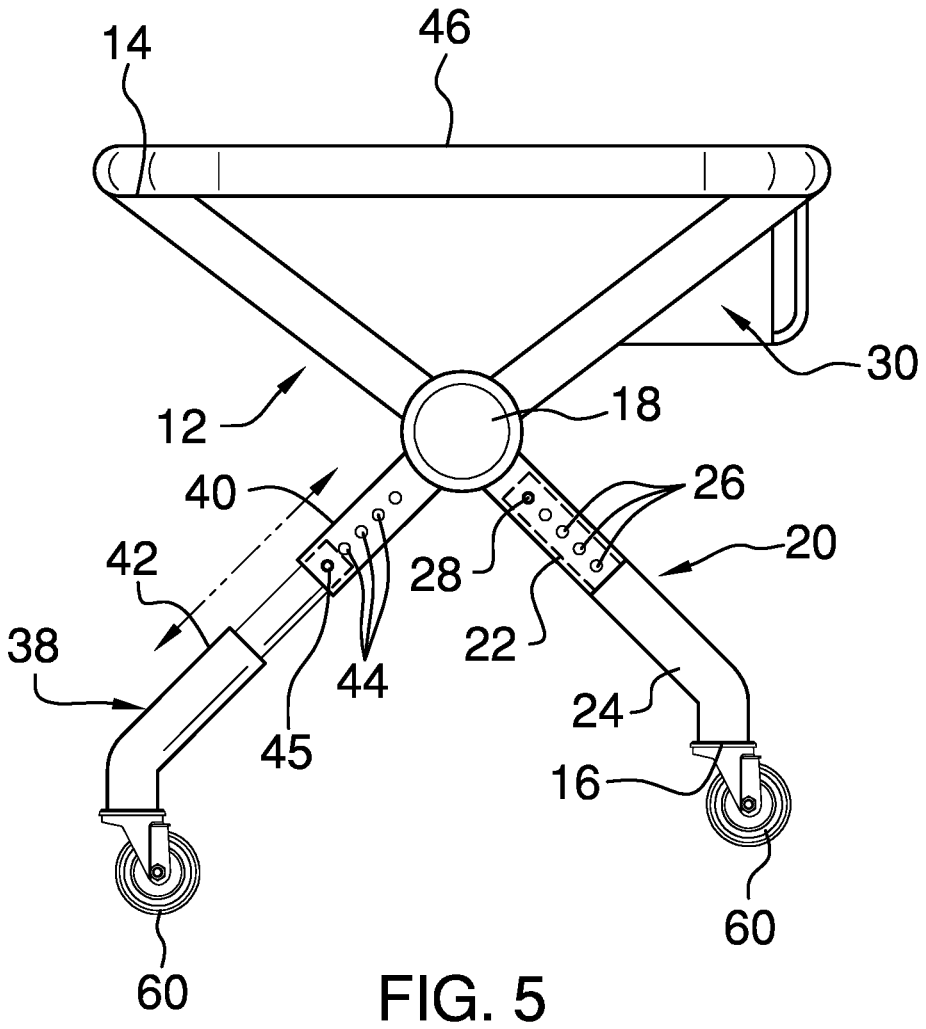
FIG. 5 is a left side view of an embodiment of the disclosure.

With reference now to the drawings, and in particular to FIGS. 1 through 6 thereof, a new walking device embodying the principles and concepts of an embodiment of the disclosure and generally designated by the reference numeral 10 will be described.

As best illustrated in FIGS. 1 through 6, the walking assistance assembly 10 generally comprises a set of first legs 12 that is each pivotally coupled together. The first legs 12 are positionable in an unfolded position having the first legs 12 forming an X. Each of the first legs 12 has a first end 14, a second end 16 and a first pivot point 18 that is centrally positioned between the first 14 and second 16 ends. Each of the first legs 12 is pivotally coupled together at the first pivot point 18.

Each of the first legs 12 includes a lower section 20 between the first pivot point 18 and the second end 16. The lower section 20 comprises a first half 22 slidably receiving a second half 24 such that the lower section 20 of each of the first legs 12 has a telescopically adjustable length. The first half 22 includes a plurality of engagement points 26 and the second half 24 includes a catch 28 that releasably engages a selected one of the engagement points 26 for retaining the lower section 20 at a selected length.

A set of second legs 30 is each pivotally coupled together and the second legs 30 are positionable in an unfolded position having the second legs 30 forming an X. Each of the second legs 30 has a primary end 32, a secondary end 34 and a second pivot point 36 that is centrally positioned between the primary 32 and secondary 34 ends. Each of the second legs 30 is pivotally coupled together at the second pivot point 36.

Each of the second legs 30 includes a bottom section 38 between the second pivot point 36 and the secondary end 34. Additionally, the bottom section 38 comprises a primary half 40 slidably receiving a secondary half 42 such that the bottom section 38 of each of the second legs 30 has a telescopically adjustable length. The primary half 40 has a plurality of engagement points 44 thereon and the secondary half 42 includes a catch 45 that releasably engages a selected one of the engagement points 44 on the primary half 40 for retaining the bottom section 38 at a selected length. The engagement points 26,44 on each of the first 22 and primary 40 halves may comprise a plurality of apertures, and the catch 28,46 on each of the second 24 and secondary 42 halves may comprise a ball that engages a selected one of the apertures.

A frame 46 is provided and the frame 46 is coupled to each of the sets first 12 and second 30 legs. Moreover, the frame 46 is horizontally oriented when the first 12 and second 30 legs are in the unfolded position thereby facilitating the frame 46 to surround a user 48. The user 48 may be an elderly person, a physically disabled person or any other person that has difficulty walking without assistance. Each of the first 12 and second 30 legs supports the frame 46 such that the frame 46 can support the weight of the user 48. In this way the frame 46 assists the user 48 with standing by allowing the user 48 to lean upon the frame 46 as much as necessary for the user 48 to stand.

The frame 46 comprises a pair of side members 50 each extending between a front member 52 and a rear member 54; the front 52 and rear 54 members are spaced apart from each other such that the frame 46 defines a rectangle. The frame 46 is attached to the first end 14 of each of the first legs 12 and the primary end 32 of each of the second legs 30. Additionally, the first end 14 of each of the first legs 12 and the primary end 32 of each of the second legs 30 is aligned with a respective one of four corners of the frame 46. Each of the side 50, front 52 and rear 54 members may have a tubular shape for enhancing comfort for the user 48.

The front member 52 includes a pivoting portion 56 that is positionable in an open position to define an opening 58 in the front member 52. Thus, the user 48 can walk through the opening 58 in order to enter the frame 46. The pivoting portion 56 is positionable in a closed position to extend across and thusly close the opening 58. The pivoting portion 56 may be vertically oriented, or otherwise oriented perpendicular with the front member 52, when the pivoting portion 56 is positioned in the open position.

A plurality of rollers 60, such as casters or the like, is each rotatably coupled to a respective one of the first 12 and second 30 legs for rolling along a support surface 62. The second end 16 of each of the first legs 12 and the secondary end 34 of each of the second legs 30 has a respective one of the rollers 60 positioned thereon. Thus, the rollers 60 facilitate the user 48 to walk while leaning upon the frame 46. A seat 64 is coupled between the set of first 12 and second 30 legs for having the user 48 sit thereon and the seat 64 is positioned below the rear member 54 of the frame 46. A support 66 is coupled between the rear member 54 of the frame 46 and the seat 64 for enhancing the load capacity of the seat 64. The user 48 can sit as much or as little as needed while the user 48 is walking. In this way the user 48 does not have to rely as much on upper body strength to support themselves on the frame 46 while the user 48 is walking.

Figure 6:
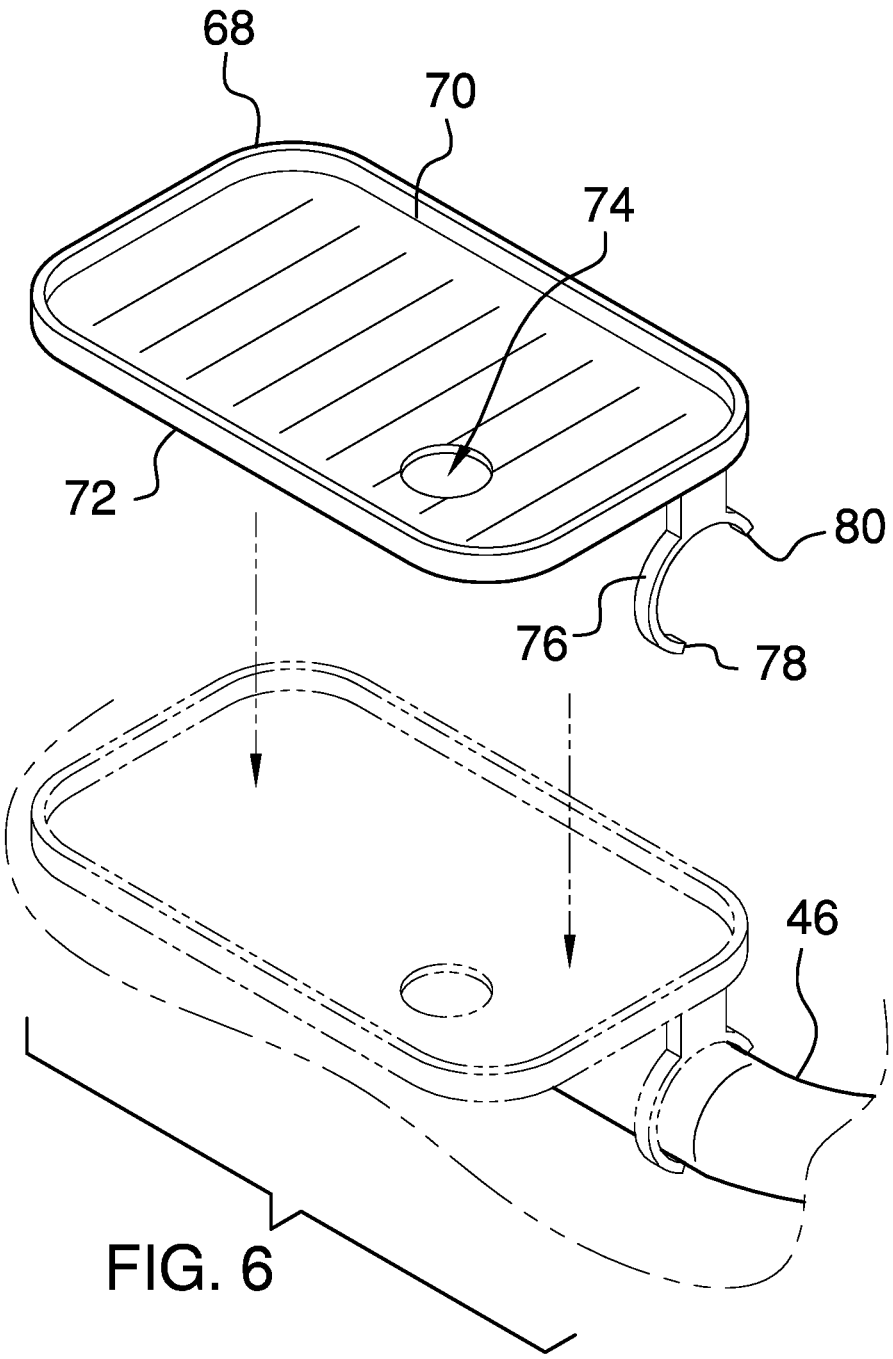
FIG. 6 is a perspective view of tray of an embodiment of the disclosure.

As shown in FIG. 6, a tray 68 is provided that has a top side 70 and a bottom side 72. A cup opening 74 extends through the top 70 and bottom 72 sides for holding a beverage cup. A clip 76 is coupled to the bottom side 72, and the clip 76 has a first end 78 and a second end 80. The clip 76 is concavely arcuate between the first 78 and second 80 ends such that the clip 76 can engage the frame 12. In this way the tray 68 can be coupled to the frame 12 at a selected location.

In use, the pivoting portion 56 of the front member 52 is positioned in the open position and the user 48 enters the frame 46. The pivoting portion 56 is positioned in the closed position when the user 48 enters the frame 46 such that the frame 46 surrounds the user 48. In this way the user 48 has support on all four sides for walking, standing or sitting. The user 48 leans upon the frame 46 for walking as much as needed, and the user 48 sits on the seat 64 as much as needed at the same time. In this way the user 48 can walk, stand or sit without any assistance almost regardless to the degree and nature of the user's 48 disability.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A walking assistance assembly being configured to surround a user and roll along a support surface thereby assisting the user with walking, said assembly comprising:

a set of first legs, said first legs being positioned having said first legs forming an X, each of said first legs having a first end and a second end;

a set of second legs, said second legs being positioned having said second legs forming an X, each of said second legs having a primary end and a secondary end;

a frame being coupled to each of said first and second sets of legs, said frame being horizontally oriented wherein said frame is configured to surround a user, each of said first and second legs supporting said frame wherein said frame is configured to support the weight of the user thereby assisting the user with standing;

a plurality of rollers, each of said rollers being rotatably coupled to a respective one of said first and second legs wherein each of said rollers is configured to roll along a support surface;

a seat being coupled between said set of first and second legs wherein said seat is configured to have the user sit thereon;

said frame having a rear member, said seat being positioned below said rear member of said frame, said seat extending forward having a front edge positioned spaced vertically below said frame and spaced vertically above respective junctions of said first set of legs and said second set of legs;

wherein said front edge of said seat is positioned behind said respective junctions of said first set of legs and said second set of legs;

wherein said frame comprises a pair of side members each extending between a front member and said rear member, said front and rear members being spaced apart from each other such that said frame defines a rectangle, said frame being attached to said first end of each of said first legs and said primary end of each of said second legs, said first end of each of said first legs and said primary end of each of said second legs being attached at a respective one of four corners of said frame; and wherein said front member comprises a pivoting portion being less than an entire length of the front member and positionable in a closed position to complete the rectangle and an open position to define an opening, wherein said opening is configured to have the user walk therethrough to enter the frame, and the pivoting portion being rotatable from the closed position to the open position out of the plane of the frame.

2. The assembly according to claim 1, wherein:

each of said first legs includes a lower section comprising a first half slidably receiving a second half such that said lower section of each of said first legs has a telescopically adjustable length.

3. The assembly according to claim 2, wherein:

each of said second legs includes a bottom comprising a primary half slidably receiving a secondary half such that said bottom section of each of said second legs has a telescopically adjustable length.

4. The assembly according to claim 1, wherein the pivoting portion rotates from the dosed position to the open position to a plane perpendicular to the plane of the frame.

5. The assembly according to claim 1, wherein the seat extends fully from one of the pair of side members to the other one of pair of side members.

6. The assembly according to claim 1, wherein a side of the sea here the user sits faces the front member which comprises the pivoting portion.

7. The assembly according to claim 1, further comprising a support which holds the seat in a fixed attached position of the rear member.

8. A walking assistance assembly being configured to surround a user and roll along a support surface thereby assisting the user with walking, said assembly comprising:

a set of first legs, said first legs being positioned having said first legs forming an X, each of said first legs having a first end and a second end, each of said first legs including a lower section comprising a first half slidably receiving a second half such that said lower section of each of said first legs has a telescopically adjustable length;

a set of second legs, said second legs being positioned having said second legs forming an X, each of said second legs having a primary end and a secondary end, each of said second legs including a bottom section comprising a primary half slidably receiving a secondary half such that said bottom section of each of said second legs has a telescopically adjustable length;

a frame being coupled to each of said first and second sets of legs, said frame being horizontally oriented when said first and second legs are in said unfolded position wherein said frame is configured to surround a user, each of said first and second legs supporting said frame wherein said frame is configured to support the weight of the user thereby assisting the user with standing, said frame comprising a pair of side members each extending between a front member and a rear member, said front and rear members being spaced apart from each other such that said frame defines a rectangle, said frame being attached to said first end of each of said first legs and said primary end of each of said second legs, said first end of each of said first legs and said primary end of each of said second legs being attached at a respective one of four corners of said frame, said front member including a pivoting portion being positionable in an open position to define an opening wherein said opening is configured to have the user walk therethrough to enter said frame, said pivoting portion being positionable in a dosed position to extend across and thusly close said opening;

a plurality of rollers, each of said rollers being rotatably coupled to a respective one of said first and second legs wherein each of said rollers is configured to roll along a support surface, said second end of each of said first legs and said secondary end of each of said second legs having a respective one of said rollers being positioned thereon;

a seat being coupled between said set of first and second legs wherein said seat is configured to have the user sit thereon, said seat being positioned below said rear member of said frame, said seat extending forward having a front edge positioned spaced vertically below said frame and spaced vertically above respective junctions of said first set of legs and said second set of legs wherein said front edge of said seat is positioned behind said respective junctions of said first set of legs and said second set of legs; and a support being coupled between said rear member of said frame and said seat for enhancing the load capacity of said seat;

wherein said front member comprises a pivoting portion being less than an entire length of the front and positionable in a closed position to complete the rectangle and an open position to define an opening, wherein said opening is configured to have the user walk therethrough to enter the frame, and the pivoting portion being rotatable from the closed position to the open position out of the plane of the frame.

9. The assembly according to claim 8, wherein the pivoting portion rotates from the closed position to the open position to a plane perpendicular to the plane of the frame.

10. The assembly according to claim 8, wherein the seat extends fully from one of the pair of side members to the other one of pair of side members.

11. The assembly according to claim 8, wherein a side of the seat where the user sits faces the front member which comprises the pivoting portion.

12. The assembly according to claim 8; wherein the support holds the seat in a fixed attached position of the rear member.

* * * * *